United States Patent [19]

Ianuzzi

[11] Patent Number: 4,821,457

[45] Date of Patent: Apr. 18, 1989

[54] VERTICAL OSCILLATING SPINDLE SANDERS

[76] Inventor: Joseph N. Ianuzzi, 3233 Knapp Rd., Vestal, N.Y. 13850

[21] Appl. No.: 170,931

[22] Filed: Mar. 21, 1988

[51] Int. Cl.[4] ..... B24B 7/00

[52] U.S. Cl. ..... 51/34 H; 51/102

[58] Field of Search ..... 51/34 H, 34 J, 102

[56] References Cited

U.S. PATENT DOCUMENTS 1,259,494 3/1918 Downer .
1,327,390 1/1920 Josias .
1,762,606 6/1930 Bjorklund .
1,881,839 10/1932 Monson .
2,114,349 4/1938 Johnson .
2,167,758 8/1939 Johnson et al. .
2,526,034 10/1950 Mathys .
3,418,758 12/1968 McEwan .
4,555,229 11/1985 Biadigo et al. ..... 51/34 H X
4,557,303 12/1985 Gardner et al. .

*Primary Examiner*—James G. Smith
*Attorney, Agent, or Firm*—Thomas R. Shaffer

[57] ABSTRACT

An oscillating vertical spindle sander is proposed which consists of a substantially hollow stand having a base member, a hydraulic motor with infinitely variable speed control in the hollow stand, a tilting spindle assembly suspended from arcuate ways on said hollow stand, a connection between motor and spindle whereby the spindle is adjustably tilted on the ways, a fixed table on said hollow stand having an elongate opening receiving the tilting spindle, a working element on the spindle and operating through the elongate opening, the working elements slidable with the spindle for movement axially, a connection from the hydraulic motor to said spindle whereby said spindle is rotated and moved axially by an hydraulic cylinder in infinitely adjustable speed control.

4 Claims, 3 Drawing Sheets

VERTICAL OSCILLATING SPINDLE SANDERS

BACKGROUND OF THE INVENTION

1. Field of the Invention

This invention relates to vertical oscillating spindle sanders and particularly to a tilting arbor or spindle which is vertically oscillable and driven by a variable speed hydraulic power unit.

2. Description of the Prior Art

In the past, spindle sanders using both rotary and oscillating cylindrical abrasive tools have been available. They all derive their oscillatory motion from the rotation of the spindle by means of a worm gear drive arrangement. Where a tilt of the workpiece is desired such prior art machines used a tilting table arrangement. Such machines had many drawbacks and shortcomings. Generally prior art machines had a single speed electric motor drive although a few had two speed electric motor drives. With a single speed certain operations are very slow, e.g. when working with a small diameter sanding sleeve, the surface speed per minute is very low. Conversely when slow material removal is an advantage, as where accuracy and control are important, this single speed can be a decided disadvantage, especially where it is desired to use a large diameter sleeve for a particular part contour. A two speed machine can be of some advantage here but only in a limited fashion. A single oscillating speed must also be accepted in a single speed machine or two with a two speed machine. This severely limits the yield and productivity of the machine. A tilting table puts an undue load on the operator who is trying to hold the work on the table while sanding. All of these disadvantages or shortcomings compromise the safety of the operator, the yield and productivity of the process and are less than desirable.

Typical of the prior art machines are U.S. Patents to Downer U.S. Pat. No. 1,259,494, Bjorklund U.S. Pat. No. 1,762,606, Monson U.S. Pat. No. 1,881,839 and McEwan U.S. Pat. No. 3,418,758. All of these machines suffer from the drawbacks discussed above. Most particularly they cannot match the speed with the work and are disadvantageous on that account above. None of the prior art has an adjustable spindle and none of the prior art shows a spindle of infinite variation from near zero to the limit desired by the operator.

SUMMARY OF THE INVENTION

I provide a machine which, on the other hand, has all of these advantages. It can have a spindle and angle as desired by the operator. It is instantly changeable at the need and desire of the operator. It is, for the first time, an infinitely variable spindle, operating on a surface which need not be tilted.

In this invention there is provided the combination comprising a base member, a tilting arbor or spindle wherein the tilting angle adjustment is electrically driven by a gear motor and controlled by a momentary, three position, center spring return selector switch for "forward-stop-reverse" motion. The tilt position of the spindle as set by the operator is shown by a tilt indicator on the side of the machine and reads out in degrees on an arcuate scale. The spindle has two motions to accomplish its work. Both are independent of the tilt angle selected and are relatively independent of each other. They are relatively independent since each may be set at any speed within its total range regardless of the other, but only relatively so because they are both drawing hydraulic fluid from the same source, although at different pressures. Thus, a change in pump pressure will affect all oil driven motions, but each can then be adjusted to whatever is desired. The two spindle motions are: (1) rotation-adjustable from near zero to the speed limitation of the hydraulic motor which drives it (which is approximately 4500 RPM) and (2) axial oscillation whose stroke length and frequency are each independently adjustable from ½" to 2" stroke length and from zero to 64 strokes per minute. This oscillating motion is driven by an hydraulic cylinder attached to a spindle housing. Oscillation reversal at each end of the stroke is by means of Hall effect switches which are slidably mounted on this cylinder. These switches control a double solenoid operated hydraulic valve which determines the direction of the hydraulic cylinder.

The spindle assembly is also equipped with a bolt mechanism which attaches to the end of the above-mentioned hydraulic cylinder and threads through the housing in which the spindle bearings are located, thus becoming the connecting member between the two. Rotating this bolt with a socket wrench will raise or lower the spindle housing of the spindle relative to the outer shaft housing. When the oscillatory motion is not desired, as is the case when contoured wheels are substituted for the abrasive sleeve tools, an electrical switch in the circuit of the lower hall effect sensor is thrown open; this brings the spindle to its lowest travel position and stops it there. The bolt is then rotated to bring the tool (a formed wheel, router bit, or shaper tool) to the desired elevation. The bolt is then manually engaged by a slidable link atop the spindle housing and the bolt is rotated slightly to snug up against the link. The bolt may be further locked by means of an allen screw located in the center axis of the bolt.

The oscillating section of the spindle and its housing are mounted in a non-oscillating larger housing which is equipped to be mounted in trunnions or supports which provide arcuate tracks for it to move in; thus allowing the tilt angle adjustment These trunnions are mounted to the underside of the fixed tabletop of the machine and are located so that the various tools can protrude through an opening of suitable size in the tabletop, and thus accomplish work.

The base or cabinet of the above combination is separated into two horizontal sections by a light steel plate. Below this plate are located the hydraulic oil reservoir, the electrical drive motor, the hydraulic pump, the rotational speed control knob, and hydraulic reservoir. The hydraulic hoses pass through a sealed bulkhead into the upper compartment where the spindle assembly and tilt assembly are located Sanding dust is sealed away from the lower compartment. A 5" dust collector port is provided for the upper compartment.

As mentioned above, the spindle can mount various diameters and lengths of cylindrical abrasive sleeves. It can also, with different shafts, mount solid plastic foam wheels which are permeated with abrasive material and which are susceptible to being contoured or edge shaped by hand held lathe type tools. When thus prepared this machine can sand intricately contoured moldings and furniture shapes. Likewise, with proper adapters, shaping or routing cutters may be mounted in the machine to accomplish these cutting operations.

The machine may be fitted with accessory fences or guides to assist in the above-mentioned sanding or cutting operations.

This machine is also designed to perform deburring operations in rings and other parts. It will also serve the plastics industry in certain plastics polishing operations, where lower speeds are the key to polishing without burning.

In the foregoing specification I have set out certain objects, advantages and review of the prior art and my invention. Other objects, purposes and advantages of this invention will be apparent from a view of the specification and drawings in which.

Figure 3:
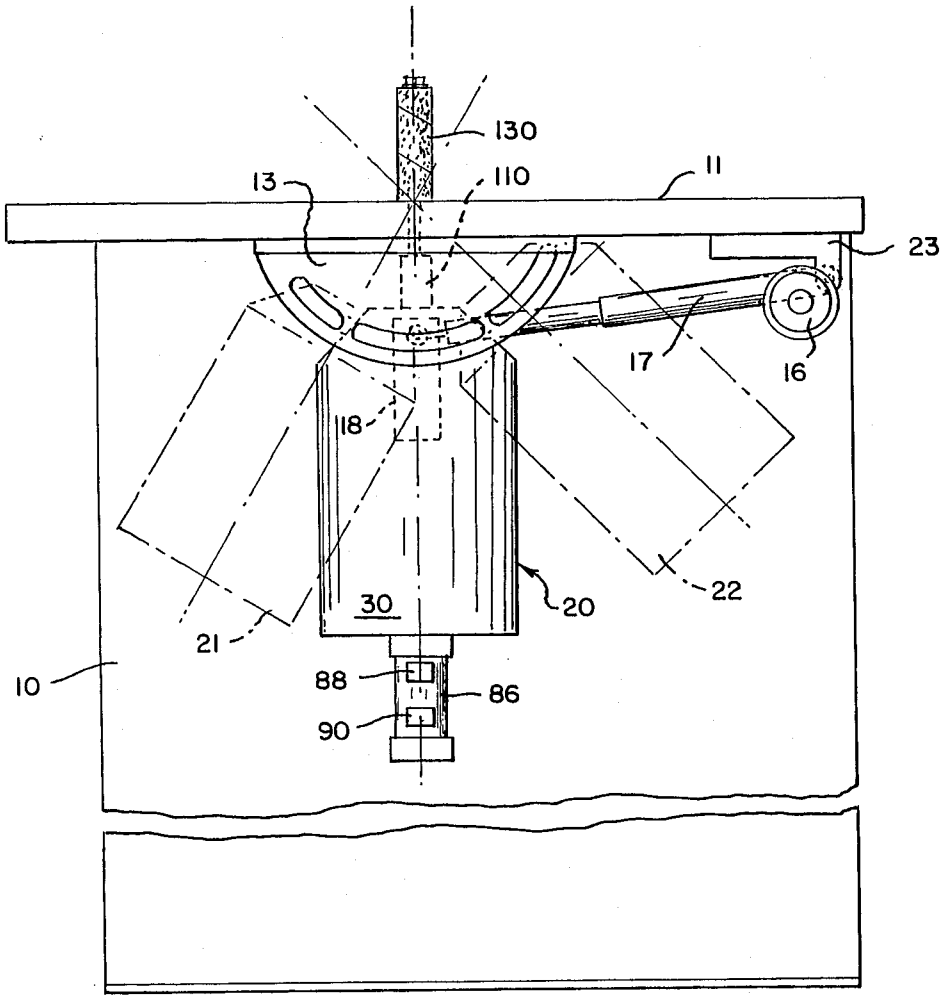
FIG. 3 is a side elevation of the drawing of FIG. 2 at 90° from that of FIG. 2 showing the position of the tilt motor in the hollow stand and the non-oscillating spindle housing with hydraulic motor and hydraulic cylinder attached.

Referring to the drawings, a hollow stand 10 with a fixed tabletop 11 is provided. Tabletop 11 is provided with a pair of spaced apart mounting brackets 13 having arcuate grooves into which spindle assembly 20 is pivotally mounted by means of ear portions 14 of assembly 20. Spindle assembly 20 may be tilted by electric gear motor 16 acting through arm 17 on structure 18 of the spindle assembly to carry the entire assembly from a frontmost position 21 to a rearmost position 22 as shown in chain line in FIG. 3. As shown in FIG. 3, the tilting spindle assembly is preferably movable further in a rearward direction than in a frontward direction by motor 16 and arm 17. Motor 16 and arm 17 are mounted to tabletop 11 by a suitable bracket 23.

Figure 1:
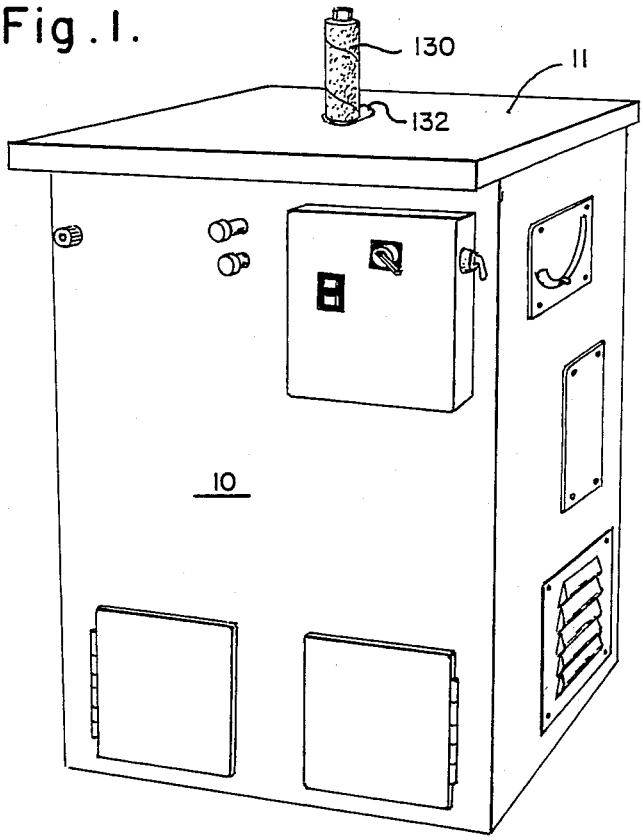
FIG. 1 is a perspective view of the combination according to my invention.
Figure 5:
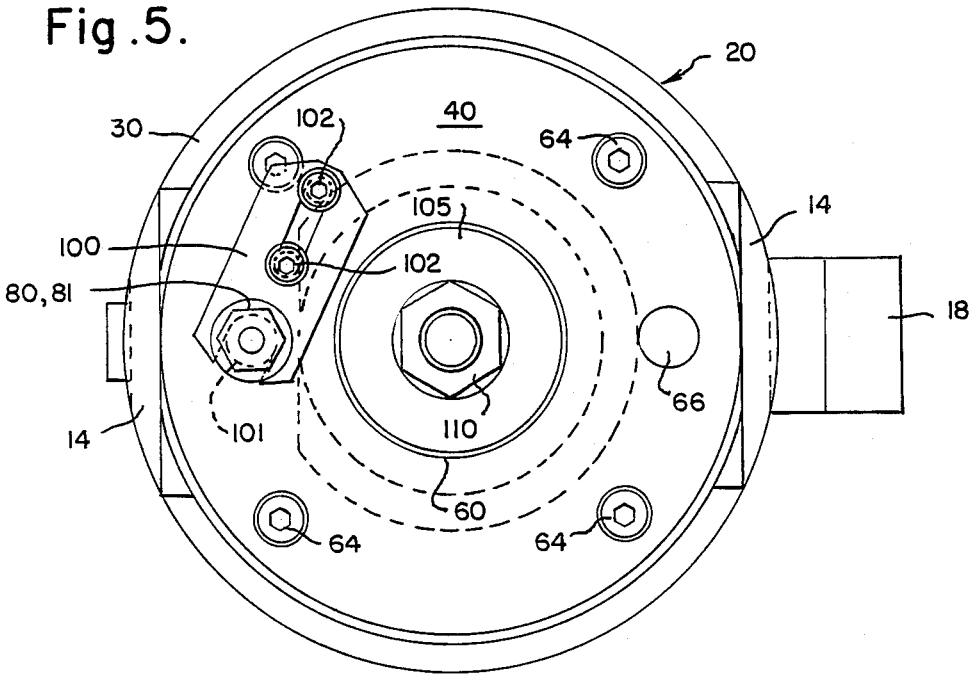
FIG. 5 is a top plan view of the spindle arrangement of FIGS. 1–4 of the invention.
Figure 2:
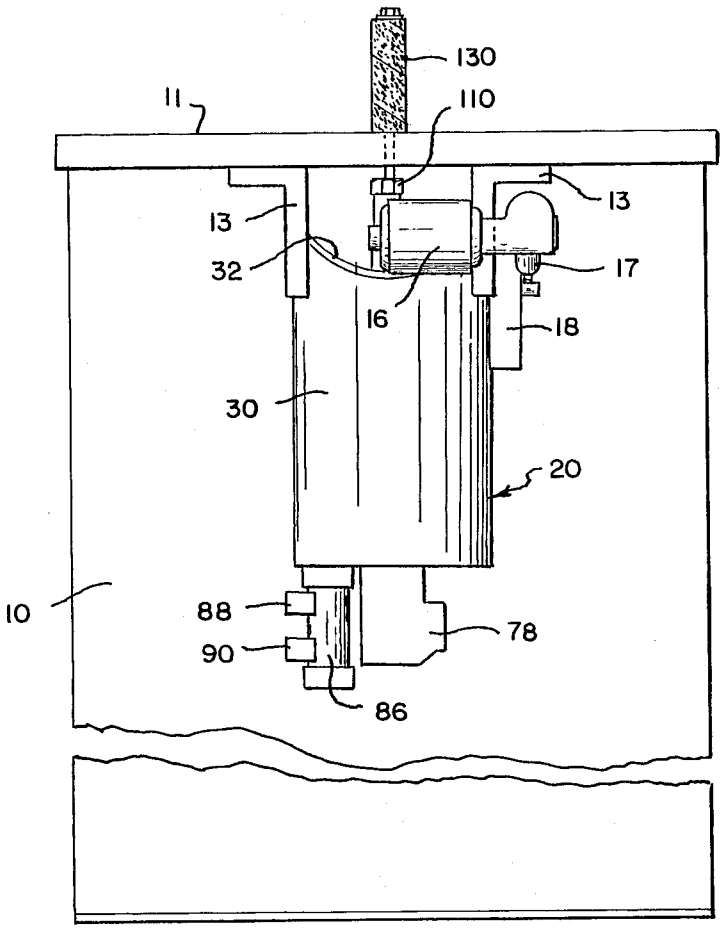
FIG. 2 is a side elevation of the drawing of FIG. 1 from the inside of the hollow stand.
Figure 4:
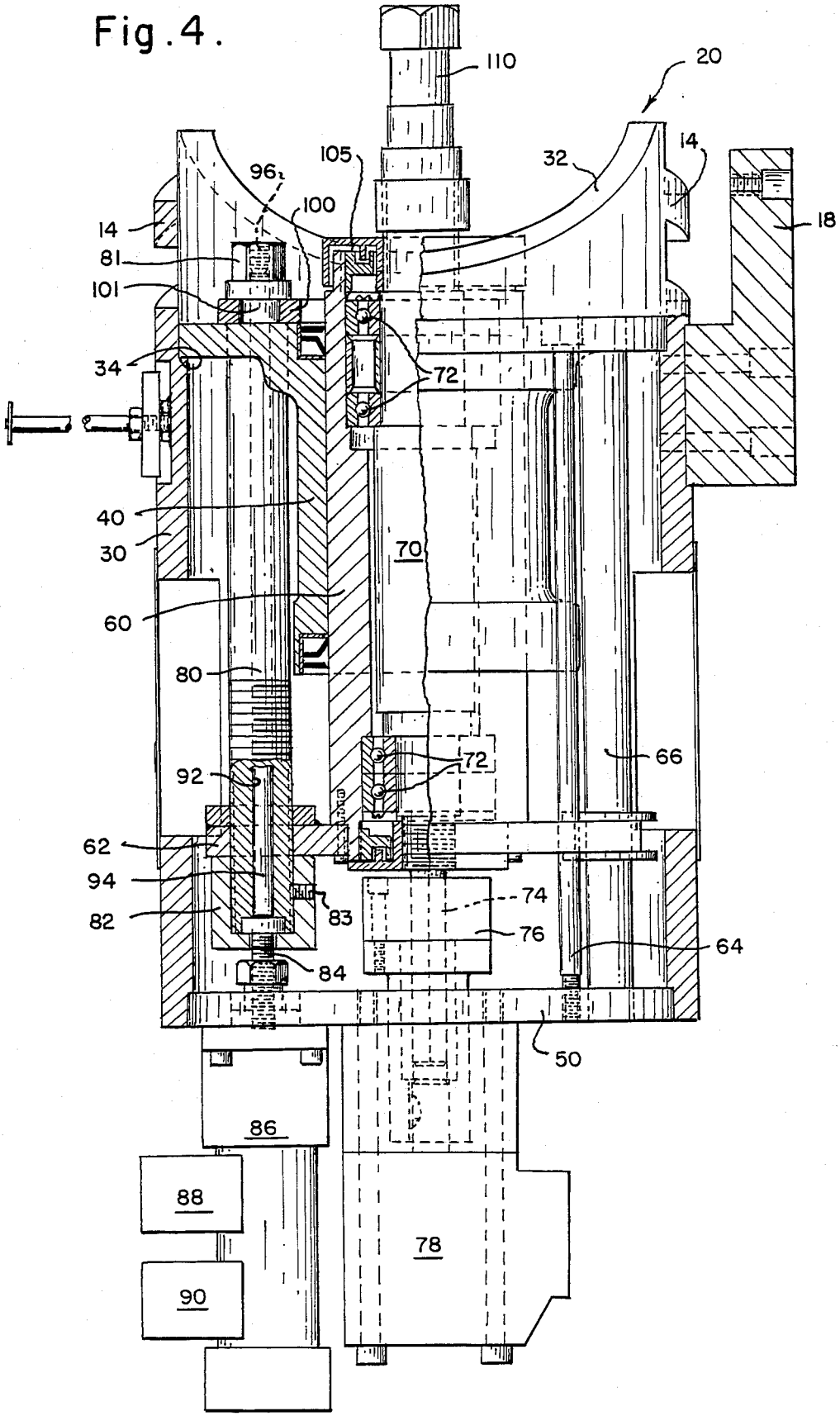
FIG. 4 is a side elevation view partly in section of the drawing of FIG. 2 showing the arrangement of the entire spindle assembly in the non-oscillatory mode.

The structural details of spindle assembly 20 are shown more clearly in FIGS. 4 and 5. Assembly 20 includes an outer cylindrical housing 30 machined to provide ear portions 14 for mounting and angle cut on side portions 32 to provide clearance for tilting. An inner housing 40 is fixed within an upper portion of outer housing 30 and rests on shoulder portions 34 thereof. A base plate 50 is mounted to the lower end of housing 30. Tie rods 64 are utilized to connect housing 40 to base plate 50.

The spindle housing 60 is adapted to oscillate vertically within housing 40. Spindle housing 60 has a base plate 62 attached at the lower end thereof through which the tie rods 64 pass. One side of the base plate 62 is adapted to slide vertically on guide rod 66 and an opposite side thereof is threaded to coact with a threaded shaft 80. The lower end of shaft of shaft 80 extends below the base plate 62 and is threaded to a cap 82 having a set screw 83 as a means of locking the shaft 80 within the cap 82. Shaft 80 is recessed at its lower end to receive the head of a bolt 84 that is threaded into the piston rod of a reciprocating hydraulic cylinder 86 having control switches 88 and 90 to regulate its stroke. The hex head 81 at the upper end of shaft 80 provides a means to rotate the shaft 80 to vertically adjust the position of the spindle housing 60 relative to the fixed housings 30 and 40. Shaft 80 has a central axial bore 92 to receive a rod 94 therein. The rod 94 engages the head of bolt 84 and is compressed by an allen set screw 96 at its upper end as a means of locking the shaft 80 against rotation and vertical positioning changes relative to housings 30 and 40 once established during the vertical oscillations.

When contouring wheels are to be used, the oscillatory motion is not desired and the spindle housing 60 is secured by a locking arrangement wherein a slotted plate 100 engages a groove 101 under the hex head 81 of shaft 80. The slotted plate 100 is slidably fastened to the inner housing 40 by bolts 102 and is retracted from the shaft groove 101 when oscillatory sanding is desired.

Finally, a spindle 70 is mounted for rotation within spindle housing 60 by means of bearings 72. The spindle 70 has a square shaft portion 74 at its lower end slidably engaged by driven coupling 76 on hydraulic motor 78. The protective cap 105 is threaded onto the upper end of housing 60 to prevent ingress of dust or other particles. A chuck 110 is provided on the upper end of spindle 70 to allow for attachment of working element 130 which is adapted to extend through an elongated opening 132 in the tabletop 11.

I claim:

1. In an oscillating vertical spindle sander or the like, the combination comprising a substantially hollow stand having a tabletop and base member, said tabletop having an elongated opening therein, a hydraulic motor with variable speed control in said hollow stand, a tilting spindle assembly connected to said hydraulic motor and including a rotatable spindle, a spindle housing and an outer housing suspended from arcuate slots on said hollow stand, said spindle housing, outer housing and hydraulic motor each positioned below said tabletop, tilting means connected to said spindle assemble whereby said spindle assembly and hydraulic motor are adjustably tilted on said slots, said tilting means including bracket means on said stand, said working element slidable with said spindle within the spindle housing for relative axial movement, a connection from said hydraulic motor to said spindle whereby said spindle is rotated and connection means between said spindle housing and said outer housing whereby said spindle housing oscillates axially relative to the outer housing by a hydraulic cylinder.

2. In an oscillating vertical spindle sander or the like as claimed in claim 1 having a locking arrangement in which the oscillatory movement of the sander or the like is prevented.

3. In an oscillating vertical spindle sander or the like as claimed in claim 1 wherein the working element is one of a sanding wheel and a sanding drum.

4. In an oscillating vertical spindle sander or the like as claimed in claim 1 wherein said tilting spindle is movable further in a rearward direction than in a frontward direction.

* * * * *